US012140056B2

(12) United States Patent
Raimondi et al.

(10) Patent No.: US 12,140,056 B2
(45) Date of Patent: Nov. 12, 2024

(54) SWITCHABLE ROCKER ARM

(71) Applicant: EATON INTELLIGENT POWER LIMITED, Dublin (IE)

(72) Inventors: Emanuele Raimondi, Turin (IT); Massimo D'Amore, Turin (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/255,068

(22) PCT Filed: Nov. 26, 2021

(86) PCT No.: PCT/EP2021/025464

§ 371 (c)(1),
(2) Date: May 30, 2023

(87) PCT Pub. No.: WO2022/111854

PCT Pub. Date: Jun. 2, 2022

(65) Prior Publication Data

US 2024/0011419 A1 Jan. 11, 2024

Related U.S. Application Data

(60) Provisional application No. 63/119,094, filed on Nov. 30, 2020.

(51) Int. Cl.
*F01L 1/18* (2006.01)
*F01L 1/46* (2006.01)

(52) U.S. Cl.
CPC ..... *F01L 1/182* (2013.01); *F01L 2001/467* (2013.01); *F01L 2305/00* (2020.05)

(58) Field of Classification Search
CPC ..... F01L 1/182; F01L 1/18; F01L 1/20; F01L 2305/00; F01L 2305/02; F01L 2001/467; F01L 2001/186; F01L 2820/033
(Continued)

(56) References Cited

U.S. PATENT DOCUMENTS 6,318,315 B1 * 11/2001 Harada ..... F01L 13/0036 123/90.15
6,604,498 B2 8/2003 Fernandez
(Continued)

FOREIGN PATENT DOCUMENTS

CN 111997704 A 11/2020
DE 102018114572 A1 12/2018
(Continued)

OTHER PUBLICATIONS

International Search Report and Written Opinion for International Application No. PCT/EP2021/025464 mailed on Mar. 17, 2022, 12 pages.

*Primary Examiner* — Kenneth J Hansen
*Assistant Examiner* — Kelsey L Stanek
(74) *Attorney, Agent, or Firm* — Baker Botts L.L.P.

(57) ABSTRACT

A switchable rocker arm (1, 2, 3, 4) can comprise a main body (10, 11) configured to rotate around a rocker shaft. The main body can comprise a valve end (102), and a cam end (103) comprising a piston bore (135, 136). A second body (21, 22, 23, 24) can comprise a pivot portion (2140, 2240, 2340, 2440), a cam-receiving transfer portion (2130, 2230, 2330, 2430), and a latch bore (2132) through the transfer portion. A latch assembly (60) can be mounted in the latch bore. A piston assembly (50) can be mounted in the piston bore.

17 Claims, 14 Drawing Sheets

(58) Field of Classification Search
USPC ..... 123/90.41
See application file for complete search history.

(56) References Cited

U.S. PATENT DOCUMENTS

| | | | | |
|---|---|---|---|---|
| 2003/0010305 | A1* | 1/2003 | Genise | F01L 1/22 123/90.46 |
| 2010/0319642 | A1* | 12/2010 | Fujita | F16C 33/62 148/320 |
| 2017/0009610 | A1* | 1/2017 | Ahmed | F01L 1/2416 |

FOREIGN PATENT DOCUMENTS

| | | | |
|---|---|---|---|
| EP | 0978637 | A2 | 2/2000 |
| JP | 2000045737 | A | 2/2000 |
| JP | 2009197732 | A | 9/2009 |
| WO | WO 2011125194 | A1 | 10/2011 |

* cited by examiner

SWITCHABLE ROCKER ARM

PRIORITY

This application is a U.S. National Phase application under 35 U.S.C. § 371 of International Application No. PCT/EP2021/025464, filed on 26 Nov. 2021, which claims the benefit under 35 U.S.C. § 119 of U.S. Provisional Application No. 63/119,094, filed on 30 Nov. 2020, which is incorporated herein by reference.

FIELD

A switchable rocker arm is provided with a latch assembly mounted through a transfer portion of a second body. A lost motion spring can be integrated with the second body. Several pivot portions are shown as alternatives for pivoting the second body relative to a main body.

BACKGROUND

Switchable rocker arms enable variable valve actuation techniques such as cylinder deactivation for a combustion machine. But packaging the switchable functionality in the tight spaces of the machine continues to be problematic.

SUMMARY

Switchable rocker arms are shown to enable variable valve actuation techniques such as cylinder deactivation and switched-lift events like early or late valve opening or closing or high or low relative lift height valve opening or closing (e.g. EEVO, EEVC, LIVC, EIVO, NVO, iEGR, engine braking, etc.). Light weight designs are desired to reduce overall machine weight. Integrated manufacturing is desired for ease of installation in the machine as either original manufacture or replacement part. But packaging the switchable functionality in the tight spaces of the machine continues to be problematic.

Several switchable rocker arms are shown to satisfy one or more goal outlined above. Such a switchable rocker arm comprises a main body configured to rotate around a rocker shaft. The main body can comprise a valve end, and a cam end comprising a piston bore. A second body can comprise a pivot portion, a cam-receiving transfer portion, and a latch bore through the transfer portion. A latch assembly is mounted in the latch bore. A piston assembly is mounted in the piston bore.

In an additional aspect, the switchable rocker arm can comprise the cam end forked to form a first arm border comprising a first piston bore and a first end wall and a second arm border comprising a second piston bore and a second end wall. The piston assembly can comprise a first piston seated in the first piston bore and a second piston seated in the second piston bore. The switchable rocker arm can comprise a hydraulic feed in the main body configured to supply hydraulic fluid to the first piston bore and to the second piston bore.

A lost motion spring can be mounted over the transfer portion. The lost motion spring can have its center of inertia balanced over the transfer portion. A spring plate can be secured to the cam end to seat the lost motion spring.

The transfer portion can comprise a bearing axle and a roller bearing mounted to rotate on the bearing axle. The bearing axle can comprise a latch bore. The latch assembly can comprise a first latch and a second latch biased out of the latch bore.

The transfer portion can comprise a hollow body configured to frame the bearing axle. The transfer portion can be further configured to seat the lost motion spring. The second body can be configured to anchor to the pivot portion. The pivot portion can comprise a pair of rocker shaft bearings configured to rotate around the rocker shaft. The second arm can comprise a stamped sheet forming a hollow body, the pivot portion, and a connecting body. The connecting body can span a section of the main body between a rocker shaft bore and the cam end.

The switchable rocker arm can comprise a spring frame comprising a first prong for abutting the transfer portion, a second prong for abutting transfer portion, and a spring seat spanning between the first prong and the second prong. The spring frame can cup the transfer portion from a first side, and the second body can comprise a hollow frame that cups the transfer portion from the first side. Or, the spring frame can cup the transfer portion from a first side, and the second body can comprise a hollow frame that cups the transfer portion from a second side.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

BRIEF DESCRIPTION OF THE DRAWINGS

FIG. 4AA shows the latch assembly unlatched by the piston assembly. The second body is ready to move relative to the main body.

FIG. 4BB shows the second body moved in a lost motion direction (indicated by the arrow). A travel stop and travel limit combination restricts the motion of the second body, which combination is an option to enable other variable valve lift techniques.

DETAILED DESCRIPTION

Figure 1:
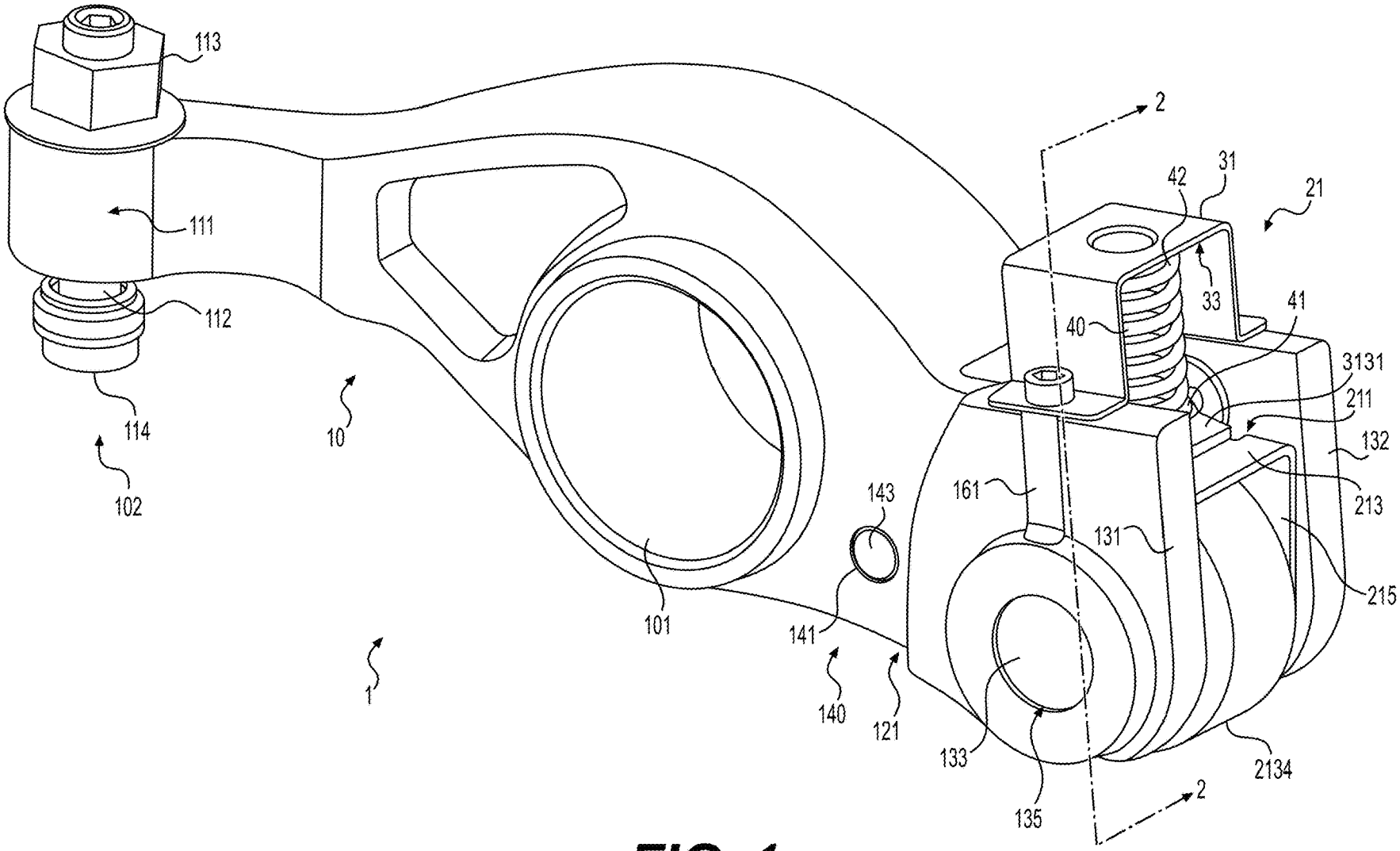
FIG. 1 is a perspective view of a rocker arm.

Reference will now be made in detail to the examples which are illustrated in the accompanying drawings. Wherever possible, the same reference numbers will be used throughout the drawings to refer to the same or like parts.

Several switchable rocker arms are shown in the Figures to satisfy one or more goal of light weight, integrated assembly, and tight packaging. Such a switchable rocker arm 1-4 can comprises a main body 10, 11 configured to rotate around a rocker shaft. The main body 10, 11 can comprise a valve end 102, and a cam end 130. The valve end 102 can comprise a knuckle for acting on a valve stem or valve bridge, or the valve end 102 can comprise a socket 111 for a capsule or spigot for a function such as lash adjustment, engine braking, among others. As illustrated, socket 111 comprises a lash pin 112, lash nut 113, and e-foot (elephant foot) 114. The cam end 103 can comprise at least one piston bore 135, 136. Preferably, the cam end 103 is forked to provide two piston bores 135, 136. Then, a second body 21-24 can be seated to selectively pivot between the forked portion of the cam end 103.

The second body 21-24 can comprise a pivot portion 2140, 2240, 2340, 2440, a cam-receiving transfer portion 2130, 2230, 2330, 2430, and a latch bore 2132 through the transfer portion. A latch assembly 60 is mounted in the latch bore 2132. A piston assembly 50 is mounted in the at least one piston bore 135, 136.

The main body 10, 11 can be light-weighted by including hollows. A rocker shaft bore 101 can be included with or without a bushing to orient the rocker arm 1-4 on a rocker shaft. A rocker shaft can supply hydraulic fluid to control the piston assembly 50. A hydraulic assembly 150 can be configured with a hydraulic port 151, a hydraulic feed 152, hydraulic outlets 153, 154, and optionally a leak port 155.

The switchable rocker arm 1-4 can comprise the cam end 103 forked to form a first arm border 131 comprising a first piston bore 135 and a first end wall 133 and a second arm border 132 comprising a second piston bore 136 and a second end wall 134. The first and second end walls 133, 134 can be formed as illustrated to comprise first and second piston bushings 53, 54 fitted in the first and second piston bores 135, 136. Or, one or both first and second piston bores 135, 136 can be formed as blind bores so that the first and second end walls are integrally formed with the first and second arm borders 131, 132. As another option, the first and second arm borders 131, 132 can be formed with fastener receptacles 161, 162 or optionally alignment posts or other mechanisms to secure the spring plate 31 or 32.

The piston assembly 50 can comprise a first piston 51 seated in the first piston bore 135 and a second piston 52 seated in the second piston bore 136. The switchable rocker arm 1-4 can comprise a hydraulic feed 152 in the main body 10, 11 configured to supply hydraulic fluid to the first piston bore 135 and to the second piston bore 136. The hydraulic feed 152 can include hydraulic outlets 153, 154 in fluid communication with the first and second piston bores 135, 136. As one option, leak ports 155 can be cross-drilled through the first and second piston bores 135, 136. Then, first and second piston bushings 53, 54 can also include an oil cup 531, 541 to collect pressurized fluid and oil feeds 532, 542 cross-drilled to received hydraulic control fluid to control pistons 51, 52. First and second piston bushings 53, 54 can comprise inner walls 534, 544 to serve as travel limits to the piston ends 515, 516. Glands or other grooves or ports can optionally be included on the first and second bushings 53, 54 and pistons 51, 52 to facilitate distribution of the hydraulic control fluid. Inner walls 534, 544 can optionally be part of blind-bore variant piston bores.

The pistons 51, 52 can comprise piston bodies 510, 520 with a piston facing 511, 521. An optional projection 512, 522 or nose can be included on the piston facings 511, 512. The projections 512, 522 can serve as travel stops to cooperate with travel limits 2161, 2162. A pressure chamber 513, 523 can be included in the piston bodies 510, 520. The small diameter of the pistons 51, 52 can result in low volume, high response time actuation of the hydraulic control fluid.

In lieu of an overhead reaction bar, a lost motion spring 40 can be mounted over the transfer portion 2130, 2230, 2330, 2430. The lost motion spring 40 can have its center of inertia balanced over the transfer portion 2130, 2230, 2330, 2430. A spring plate 31, 32 can be secured to the cam end 103 to seat the lost motion spring 40. A first spring end 41 can be biased against a portion of the second body 21-24 and a second spring end 42 can be biased against the spring plate 31, 32. This biases the second body 21-24 to a position where the latch assembly 60 can latch in the piston bores 135, 136.

The spring plate 31, 32 can comprise spring plate ends 311, 312 or 321, 322 configured to couple to the forked body. For example, first and second arm borders 133, 134 include fastener receptacles 161, 162 to receive fasteners 261, 262 like screws or rivets. Or, a weld can be used to secure the spring plate 31, 32. Or, a prong, pin, screw or the like can project from the first and second arm borders 133, 134 to receive a nut or cap. Spring plate 31, 32 can comprise a lost motion seat 33 with an optional projection or groove to locate the second spring end 42. In lieu of a contiguous sheet material, a cage arrangement can be had with cage arms 323, 324. The spring plate 31 can be rectilinear in a square-like configuration (FIGS. 1, 2, 4A-6A, 6C) or the spring plate 32 can be skewed in an angular configuration (FIGS. 7A, 7B) to provide a trajectory for the spring forces of the lost motion spring 40.

The transfer portion 2130, 2230, 2330, 2430 can comprise a bearing axle 2131 and a roller bearing 2134 mounted to rotate on the bearing axle 2131. Optional needle bearings can be included between the roller bearing 2134 and the bearing axle 2131. A slider pad integrated with the bearing axle 2131 is an alternative. The bearing axle 2131 can comprise a latch bore 2132. The latch assembly 60 can comprise a first latch 61 and a second latch 62 biased out of the latch bore 2132. If only one piston 51 or 52 were used, then only one latch 61 or 62 would be needed. A blind bore, snap ring, bushing, or other stay could be used to bias the one latch 61 or 62 in the direction of the one piston 51 or 52. But, as drawn, a latch spring 615 can push latch ends 613, 623 apart to form a latch cavity 616. Latch spring 615 can seat in spring cups 614, 624 in the latch bodies 611, 621. Latch facings 612, 622 can face the pistons 51, 52 to push the pistons 51, 52 into the piston bores 135, 136 until hydraulic control fluid is used to collapse the latch spring 615 and abut the latch ends 612, 623. Other travel limits could be used for the latches 61, 62, such as bushings, cast walls, snap rings, among others. With the arrangement, it is possible to have a dry latch bore 2132 without the use of hydraulic control fluid. The second body 21-24 could be lubricated via the piston bores 135, 136 or a hydraulic feed in the main body 10, 11, or not at all. The rotating cam could be lubricated via the main body 10, 11 but not via the second body 21-24, yielding a lighter, less complex second body 21-24.

Figure 2:
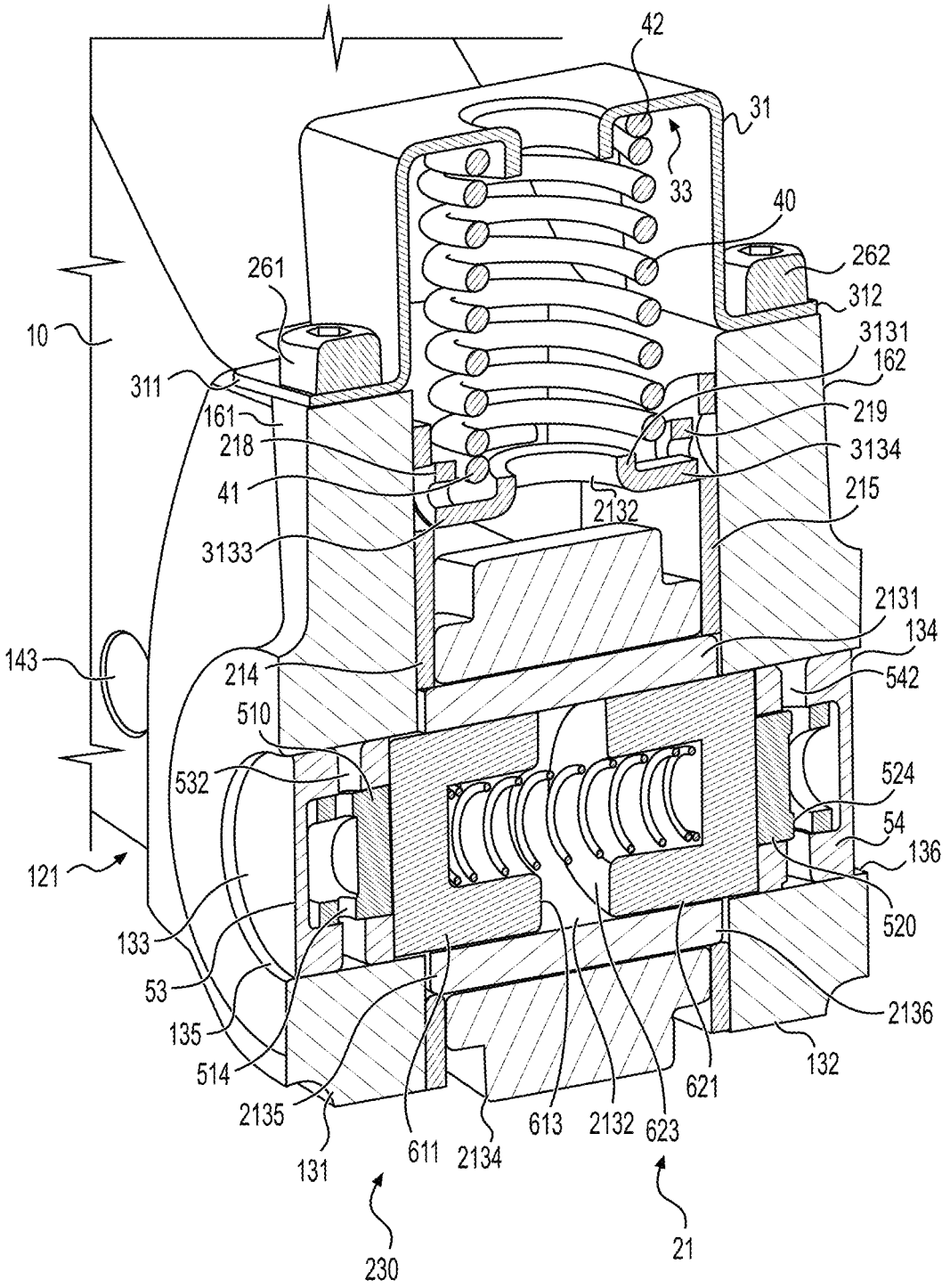
FIG. 2 is a cross section view of a portion of the rocker arm of FIG. 1 showing a latch assembly and piston assembly in a transfer area.
Figure 3:
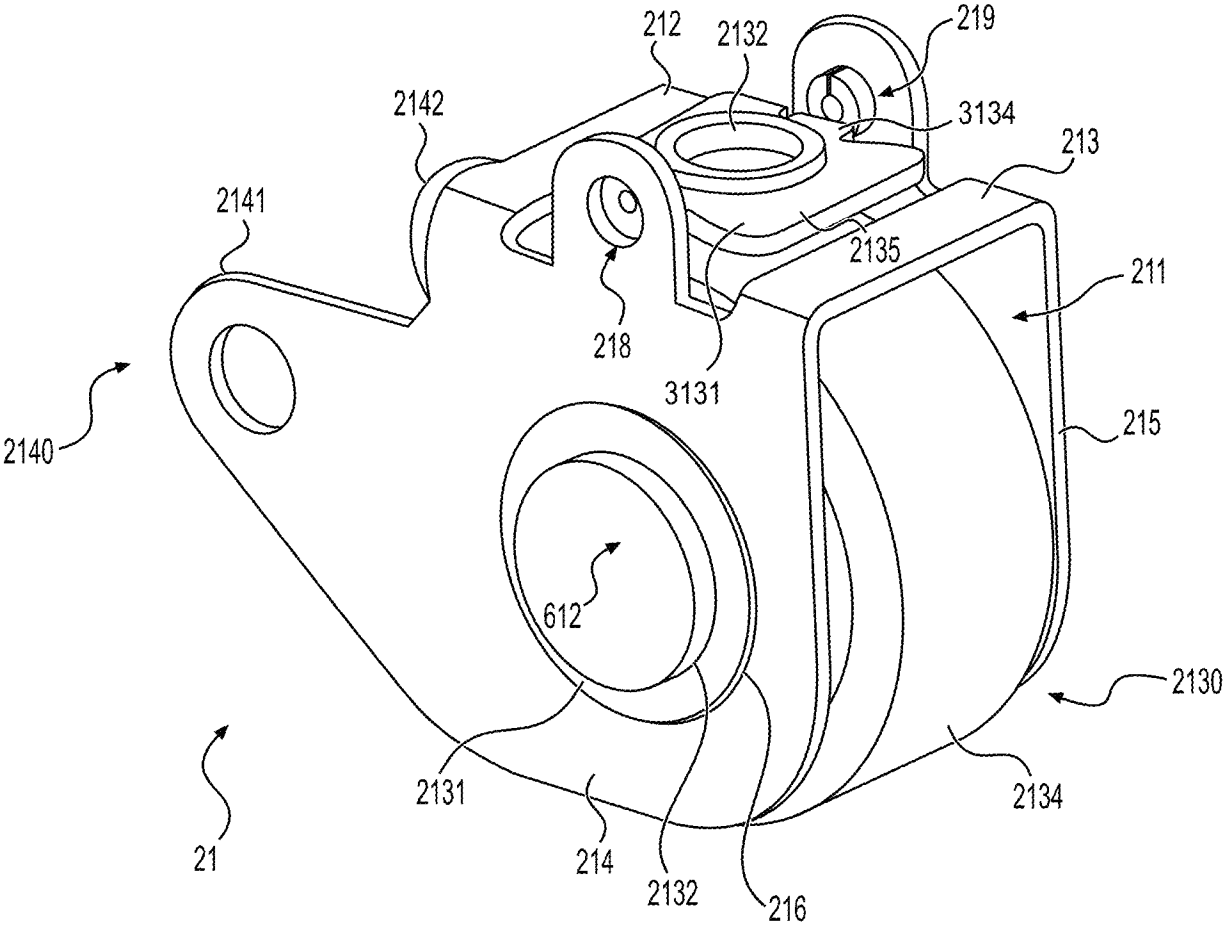
FIG. 3 is a view of a second body.

In a first arrangement, second body 21 can couple to pivot mounts 141, 142 via a pivot axle 143. Pivot area 140 is near the cam end 103 and is formed by part of the main body 10 connecting to pivot portion 2140 of second body 21. Second body 21 can comprise pivot mounts 2141, 2142 to connect to pivot axle 143. Transfer portion 2130 can comprise a hollow body 211 configured to frame the bearing axle 2131. Ends 2135, 2136 of the bearing axle 2131 can be secured in bearing slots 216, 217. Hollow body can comprise connecting joists 212, 213 for spanning over the transfer portion 2130 and for seating the lost motion spring 40. Struts 214, 215 can extend from the connecting joists 212, 213 to comprise the bearing slots 216, 217. Optional platform sockets 218, 219 can extend from the struts 214, 215 or connecting joists 212, 213 to form a pivot location for a spring platform 3131. Spring platform 3131 can seat the lost motion spring 40 with an optional spring guide 2132 (which could alternatively be a groove or other guide). Platform guides 3133, 3134 can extend into the platform sockets 218, 219 to pivot the spring platform 3131. Plate portion 2135 can pivot or rock when the lost motion spring 40 contracts (FIG. 4BB) or expands back to the latching position (FIG. 2). So, the transfer portion 2130 can be configured to seat the lost motion spring 40. The second body 21 can be configured to anchor to the pivot portion 140. The second arm 21 can comprise a stamped sheet forming a hollow body 211, the second pivot portion 2140, and a connecting joist 212, 213.

Figure 4A:
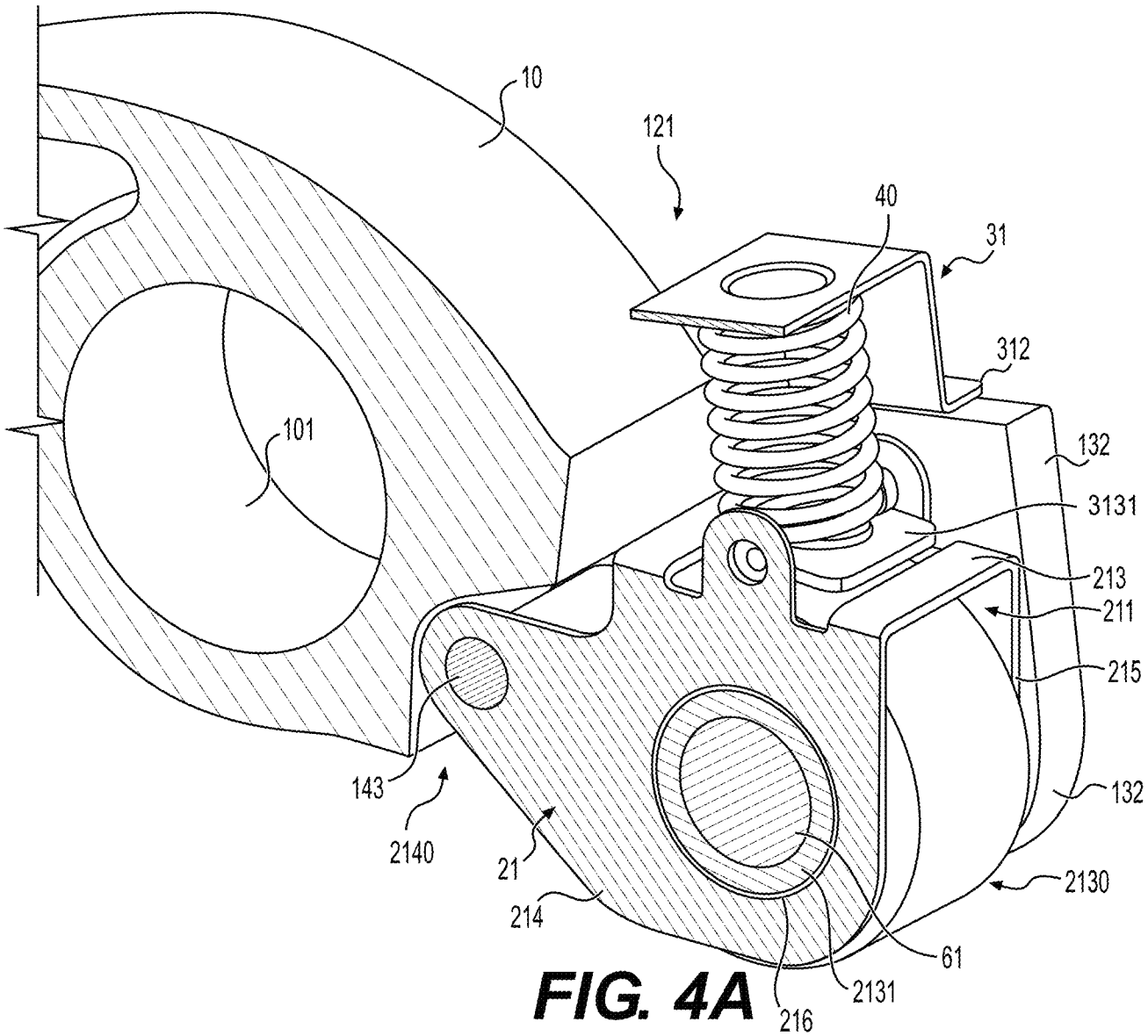
FIGS. 4A & 4B are comparative views of a second body positioned in a main body, with FIG. 4B showing a lost motion position.
Figure 4B:
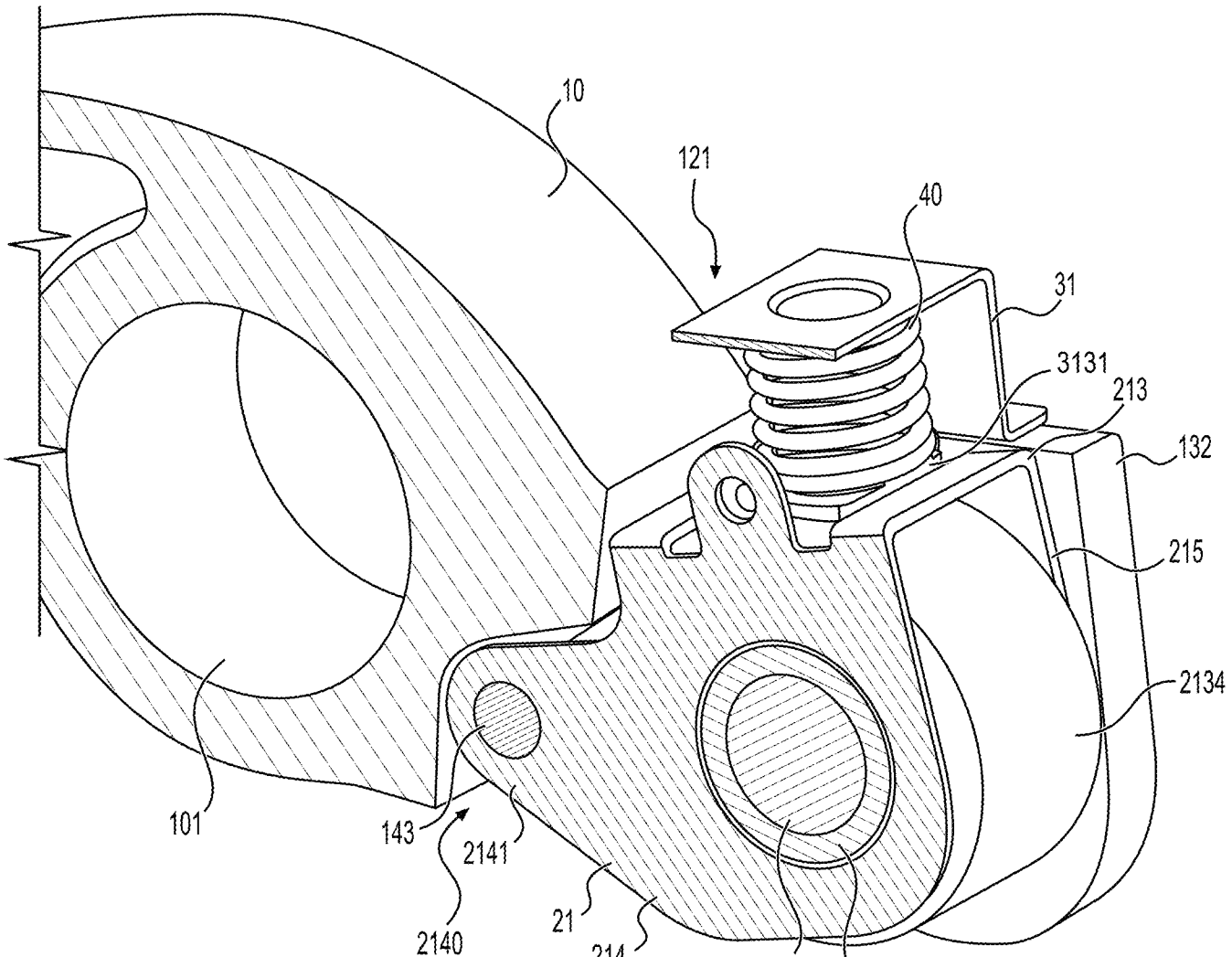
Figure 4A:
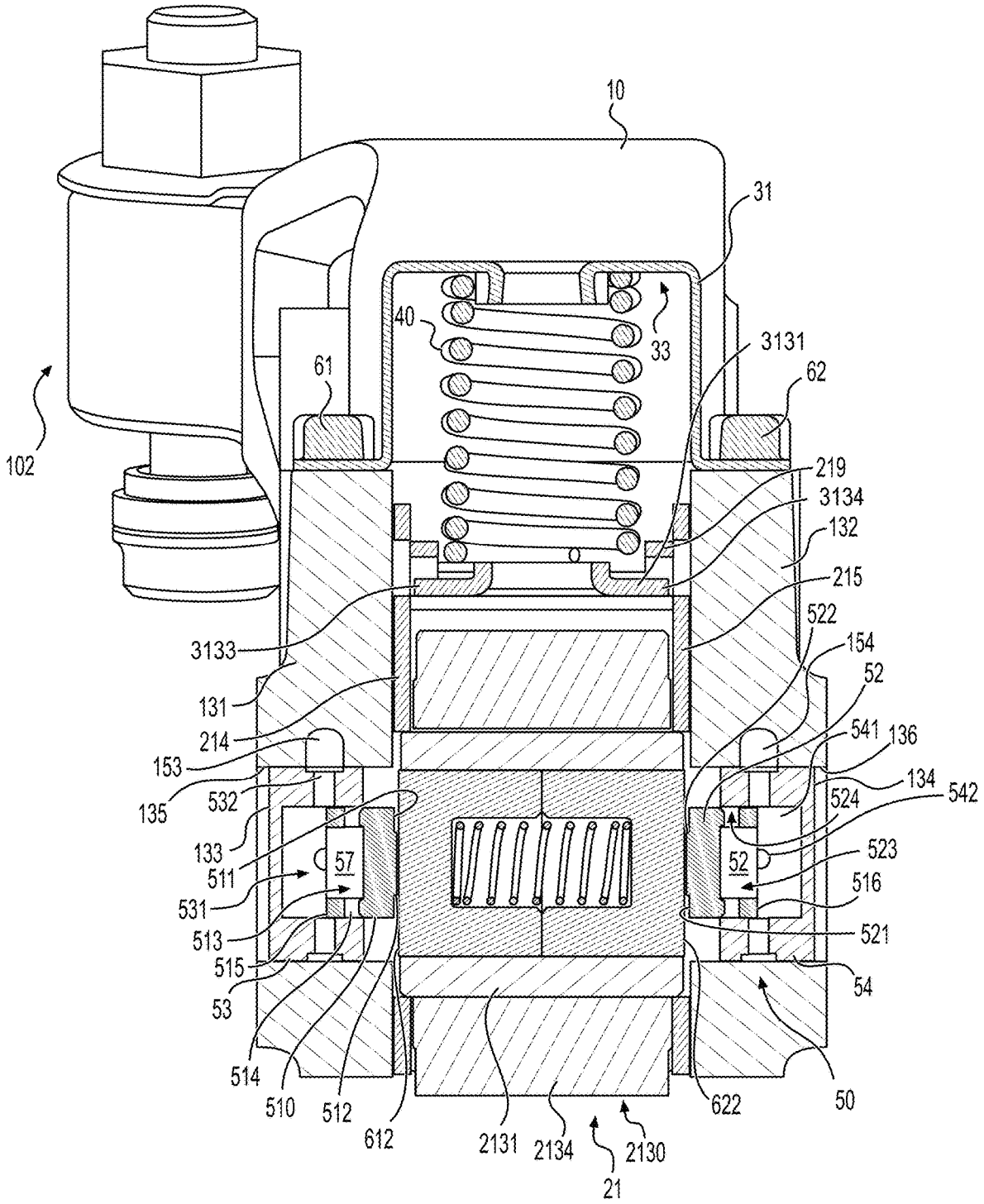
Figure 4B:
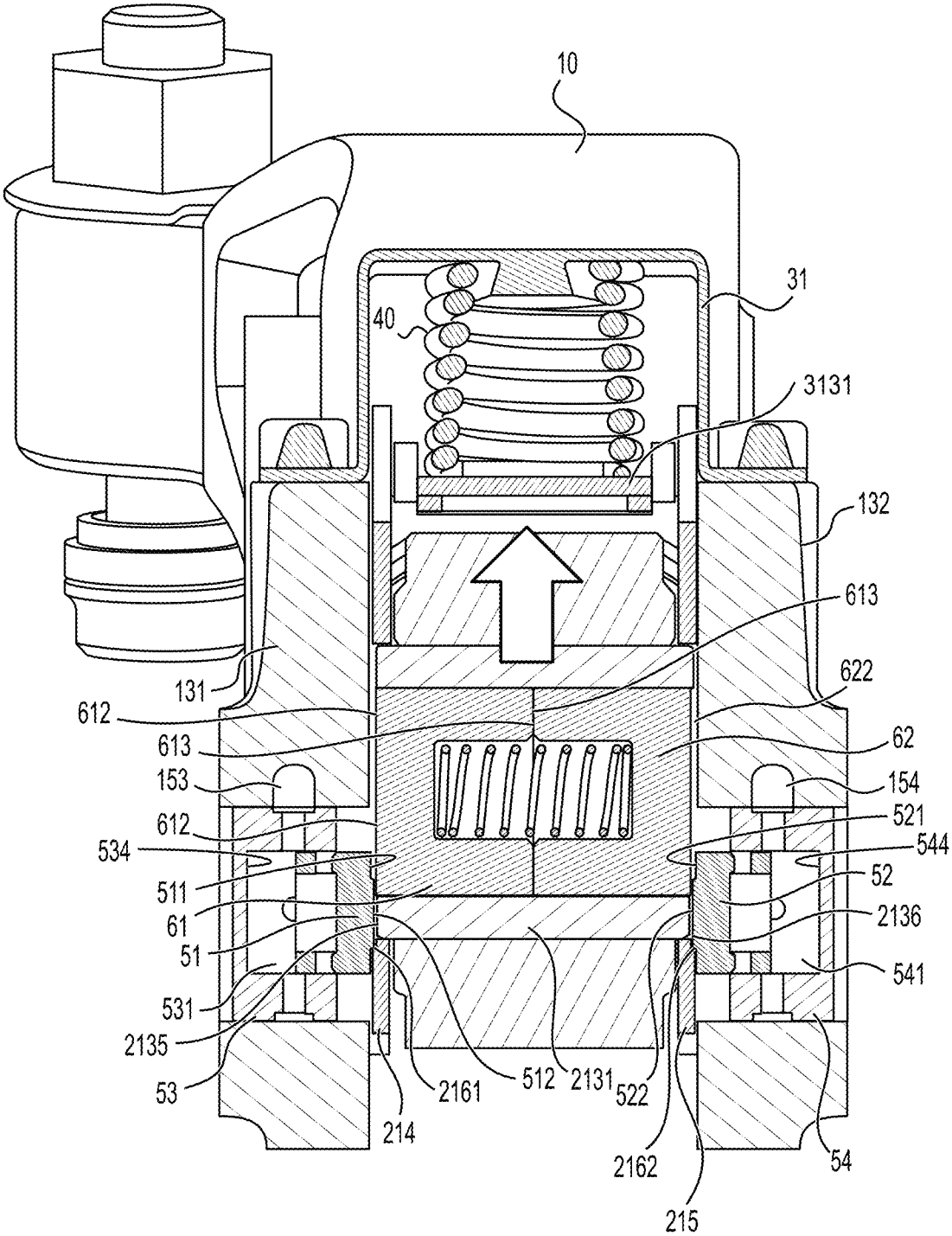

FIG. 2 shows a latching position of the latch assembly 60. FIG. 4AA shows an unlatched position, and FIGS. 4B & 4BB show a lost motion position. FIG. 4A shows a position where the latch assembly 60 is movable among the latching position and the unlatched position. These latch positions can be used with the second bodies 22-24 of FIGS. 5A-7B, with FIG. 7B showing an additional lost motion position with a cross section of a hollow roller bearing 2134.

Figure 5A:
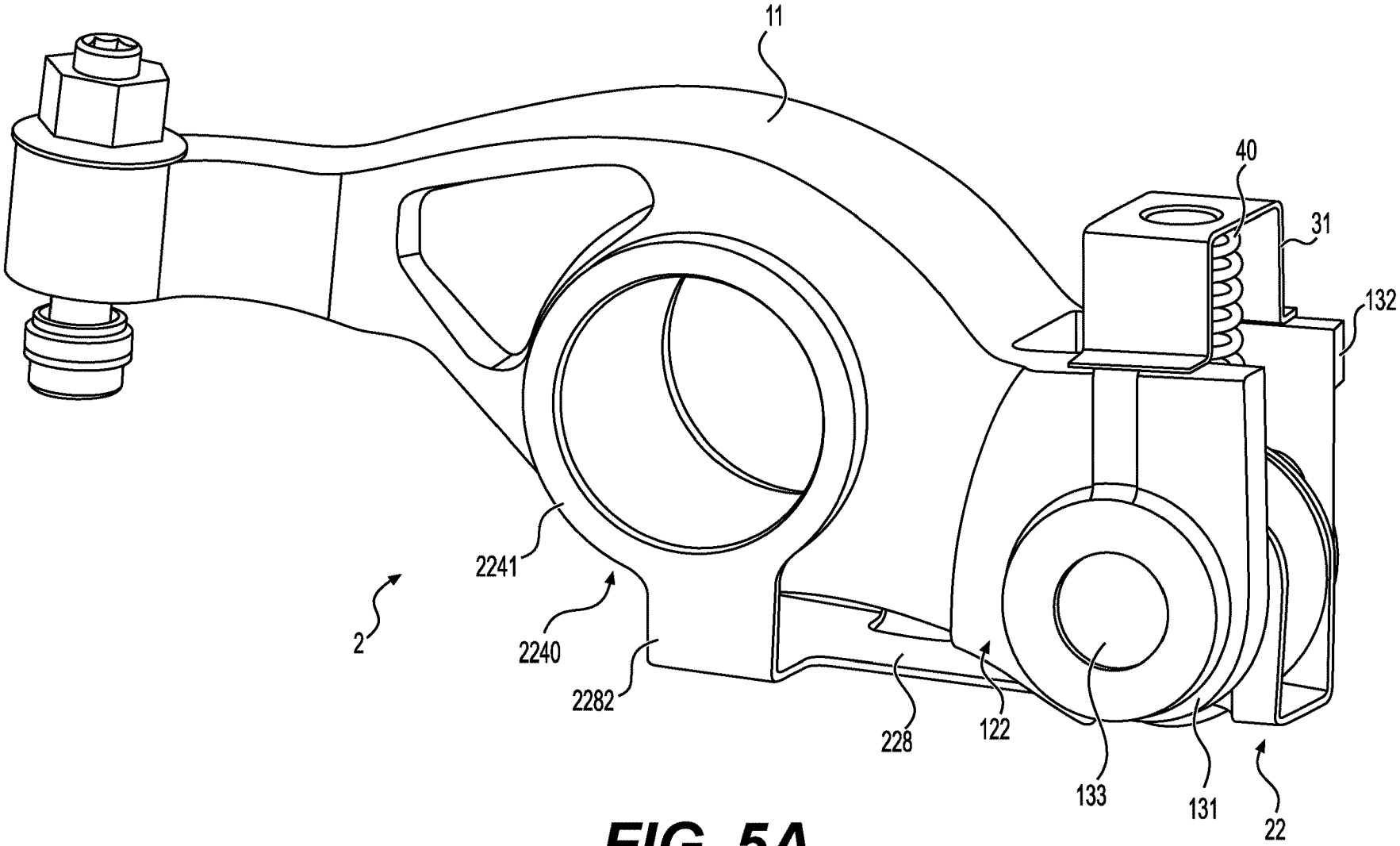
FIGS. 5A & 5B illustrate an alternative second body.
Figure 5B:
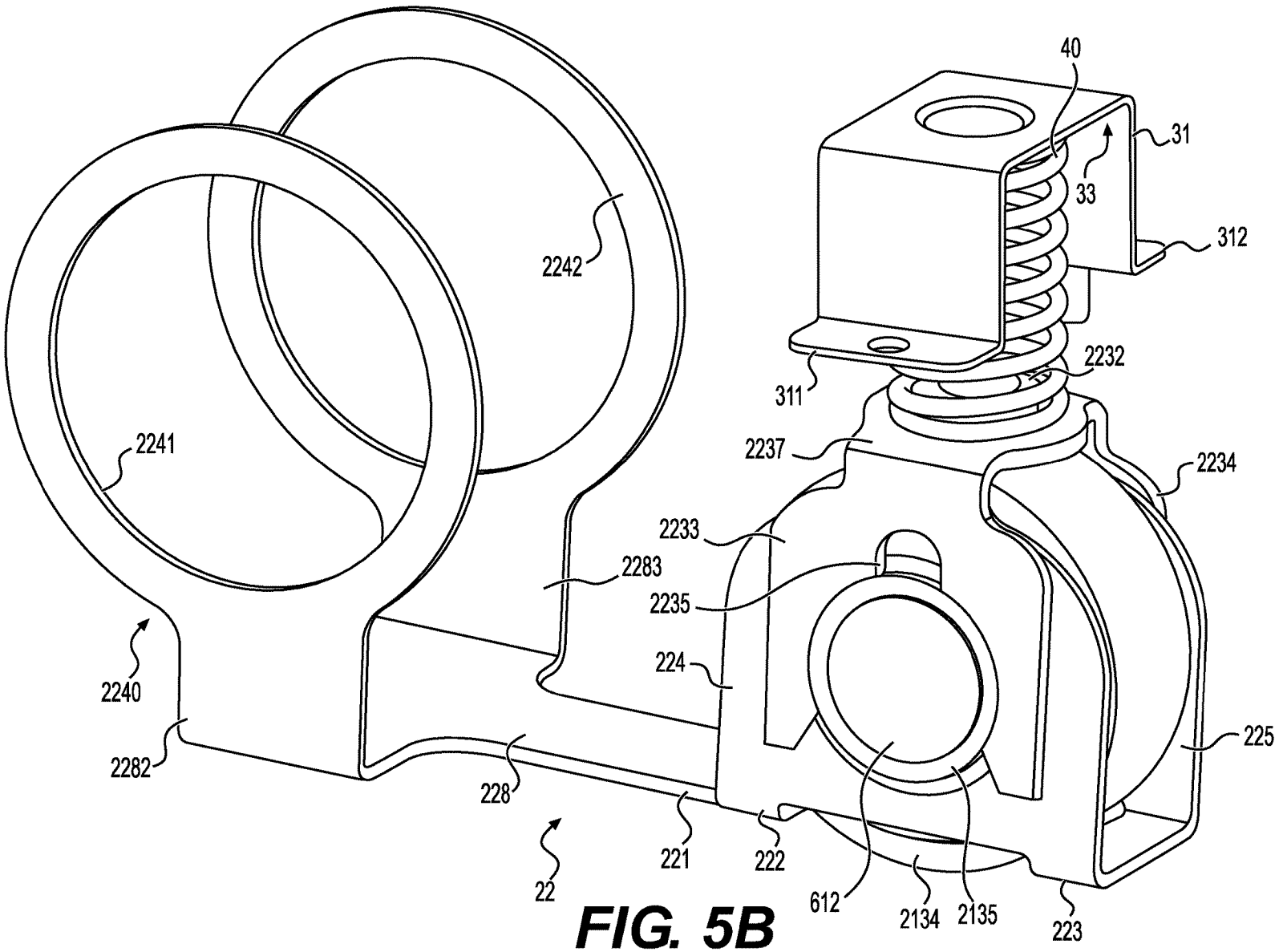

In FIGS. 5A & 5B, the transfer portion 2230 can comprise a hollow frame 221 configured to frame the bearing axle 2131. This hollow frame 221 is configured with connecting joists 222, 223 framing the roller bearing 2134 from a bottom side (a second side relative to the spring platform 3131). The struts 224, 225 comprise bearing slots 226. A drop in assembly method of the bearing axle 2131 can be furthered. A connecting body 228 extends form the hollow frame 221. Side arms 2282, 2283 extend from connecting body 228 and can comprise pivot mounts 2241, 2242 in the form of rocker shaft bearings. The pivot mounts 2241, 2242 of pivot portion 2240 are co-located with the rocker shaft bore 101 so that the rocker shaft can serve as a pivot location for both the main body 11 and the second body 22. The second body 22 can be formed of a stamped sheet material, thereby being very light weight. Low cost can be achieved. The transfer portion 2230 can be further configured to seat the lost motion spring 40. A spring platform 2231 can comprise a plate portion 2237 with an optional spring guide 2232. Platform struts 2233, 2234 can extend from the plate portion 2237 with platform bearing slots 2235. The spring platform 2231 can be dropped onto the bearing axle 2131. The platform bearing slots 2235 can be designed to clasp the bearing axle 2131. So, the second body 22 can be configured to anchor to the pivot portion 2240, herein the rocker shaft. The pivot portion 2240 can comprise a pair of rocker shaft bearings as the pivot mounts 2241, 2242 configured to rotate around the rocker shaft. The second arm 22 can comprise a stamped sheet forming a hollow frame 221, the pivot portion (pivot mounts 2241, 2242), and a connecting body 228. The connecting body 228 can span a section of the main body 11 between a rocker shaft bore 101 and the cam end 103. The spring frame (spring platform 2231) can cup the transfer portion 2230 from a first side, and the second body 22 can comprise a hollow frame 221 that cups the transfer portion 2230 from a second side.

Figure 6A:
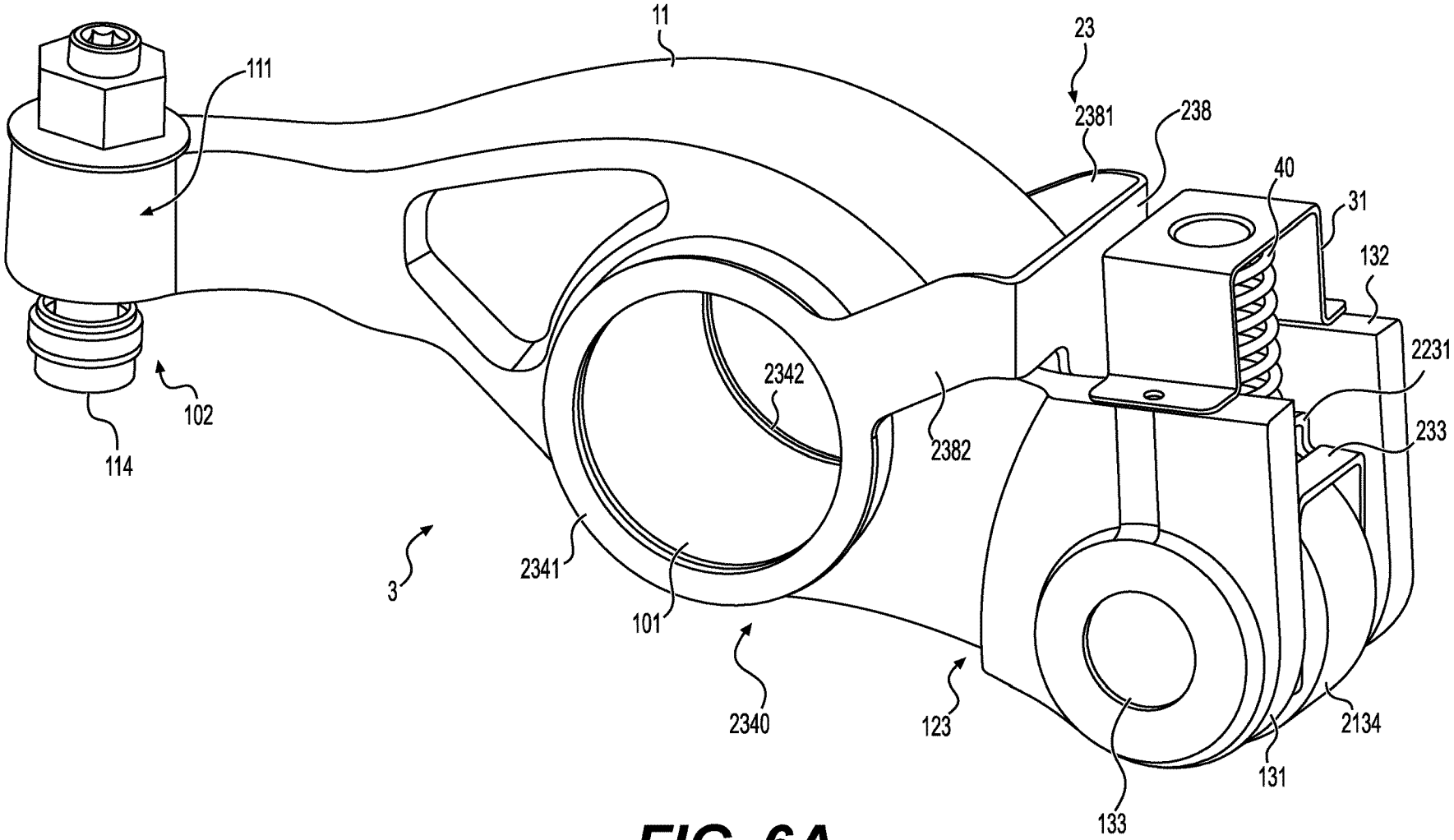
FIGS. 6A-6C illustrate an alternative second body.
Figure 6B:
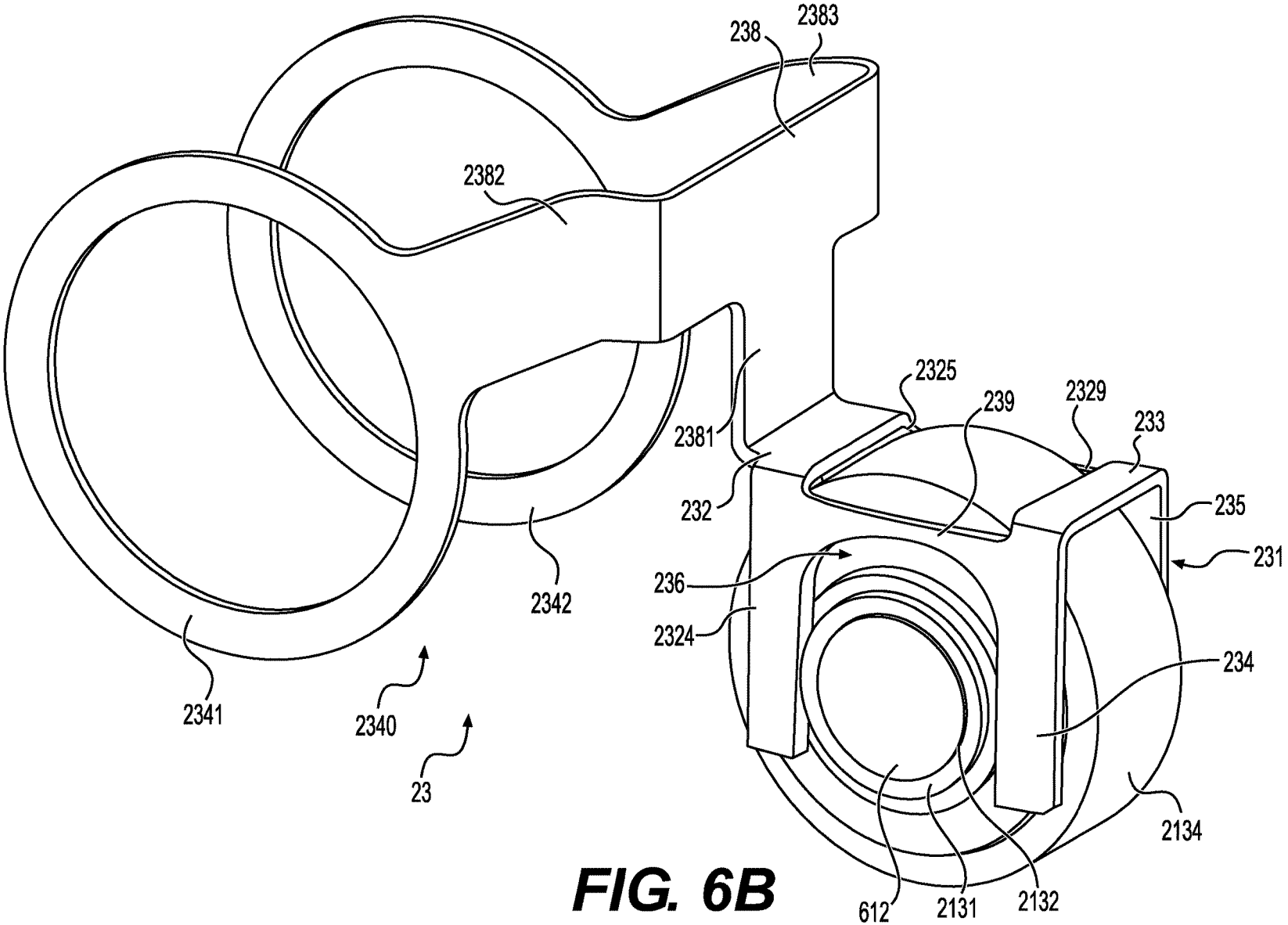
Figure 6C:
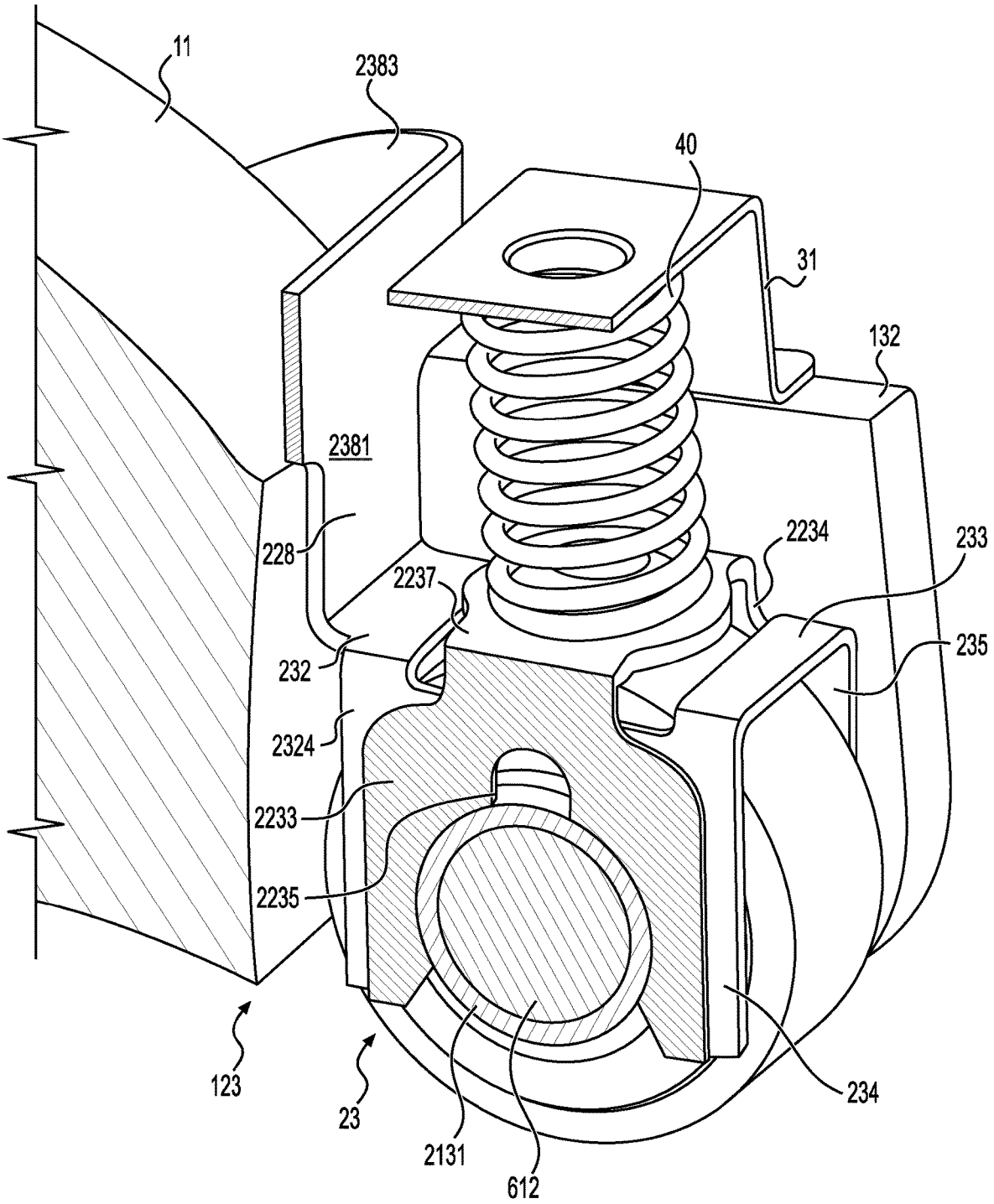
Figure 7A:
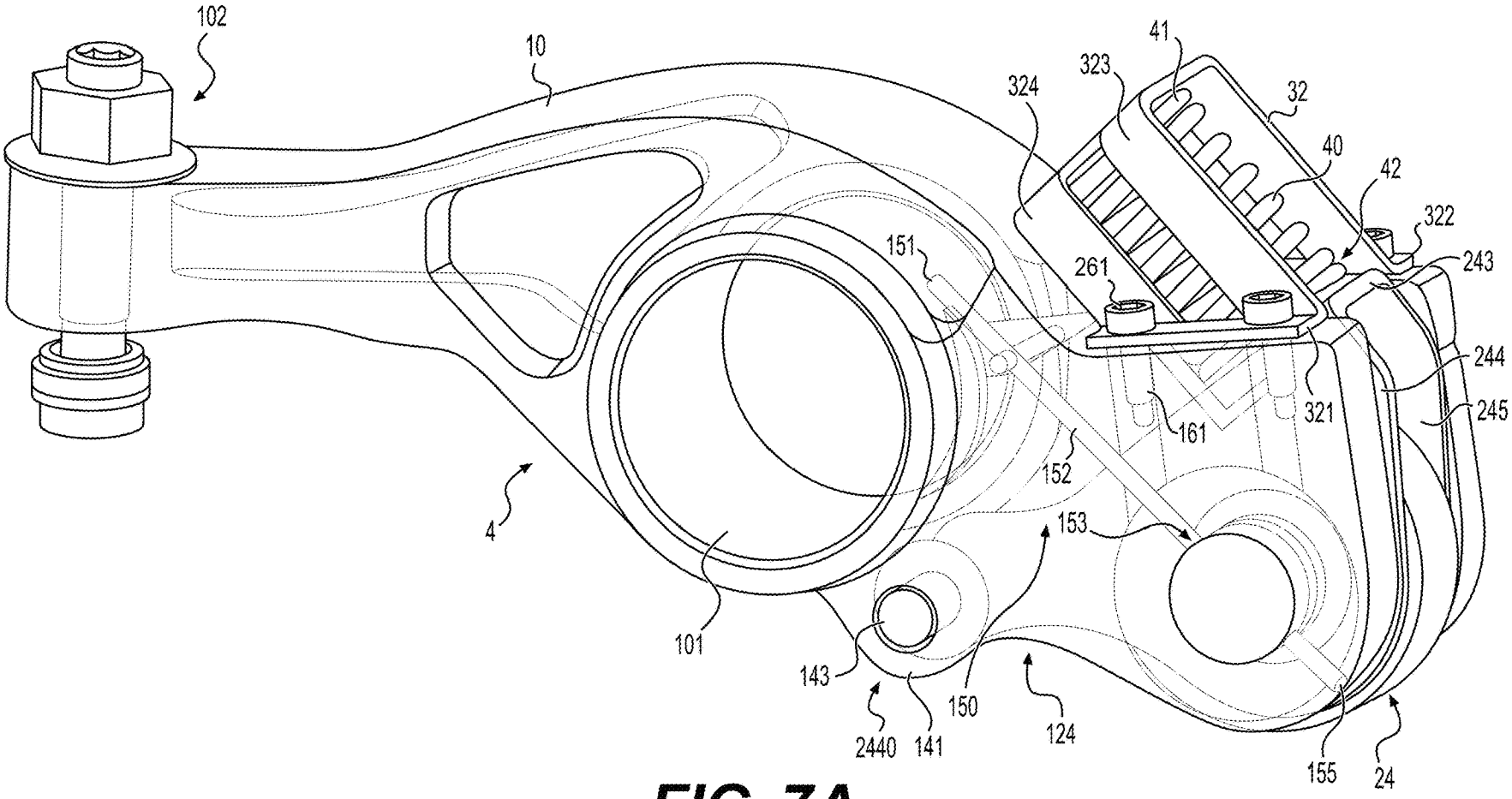
FIGS. 7A & 7B illustrate an alternative spring plate, main body, and second body.
Figure 7B:
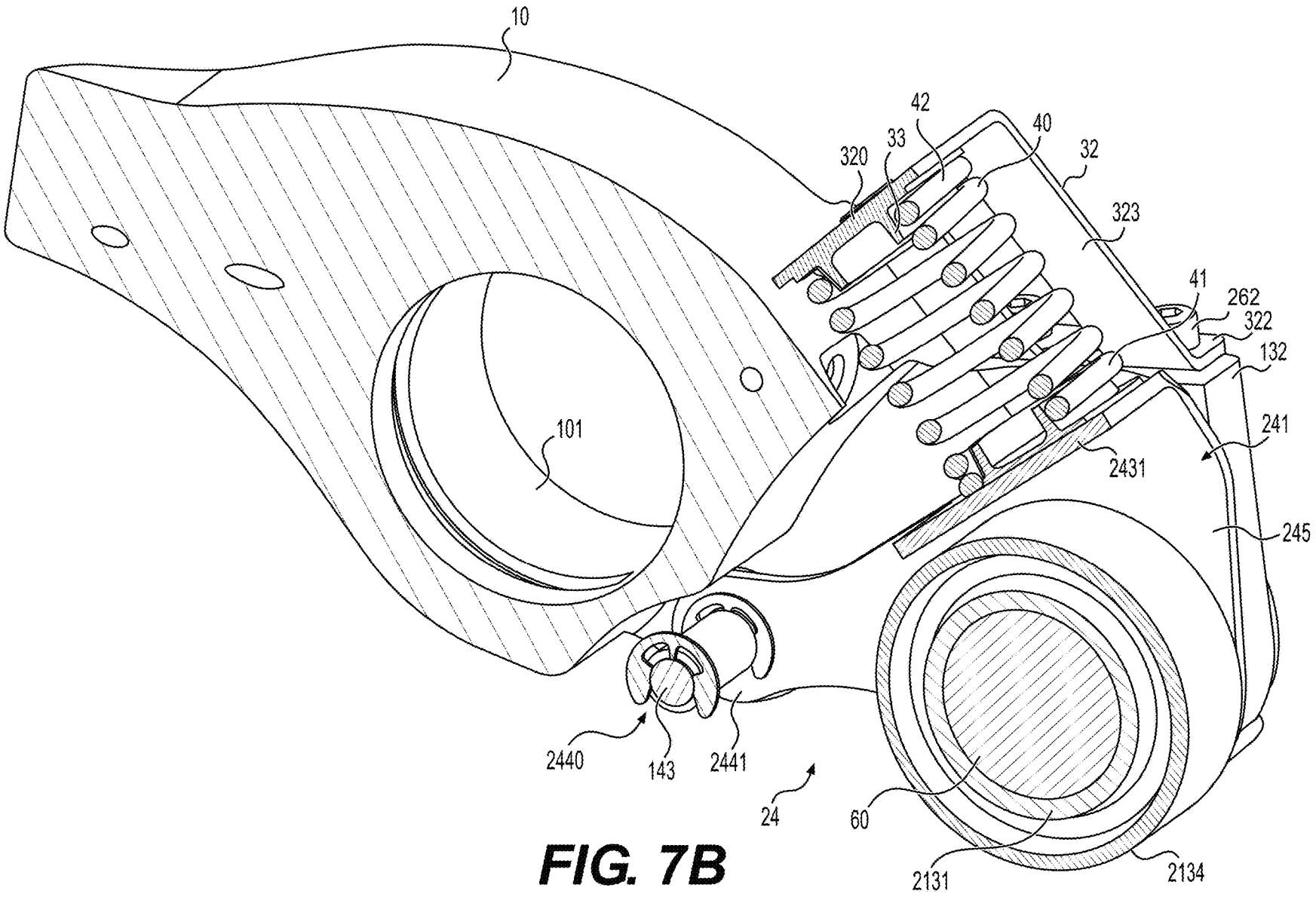

In FIGS. 6A & 6B, the transfer portion 2330 can comprise a hollow body 231 configured to frame the bearing axle 2131. This hollow body 231 is configured with connecting joists 232, 233 framing the roller bearing 2134 from a top side (a first side relative to the spring platform 2231). The struts 234, 2324, 235, 2325 are attached to beams 239, 2329 to form bearing slots 236. A drop in assembly method of the bearing axle 2131 can be furthered. A connecting body 238 extends form the hollow body 231. A bracket 2381 extends upward over a portion of the main body 11. Side arms 2382, 2383 extend from bracket 2381 of connecting body 238 and can comprise pivot mounts 2341, 2342 in the form of rocker shaft bearings. The pivot mounts 2341, 2342 of pivot portion 2340 are co-located with the rocker shaft bore 101 so that the rocker shaft can serve as a pivot location for both the main body 11 and the second body 23. The second body 23 can be formed of a stamped sheet material, thereby being very light weight. Low cost can be achieved. The transfer portion 2330 can be further configured to seat the lost motion spring 40. A spring platform 2231 can be configured as above. The spring platform 2231 can be dropped onto the bearing axle 2131. The platform bearing slots 2235 can be designed to clasp the bearing axle 2131. So, the second body 23 can be configured to anchor to the pivot portion 2340, herein the rocker shaft. The pivot portion 2340 can comprise a pair of rocker shaft bearings as the pivot mounts 2341, 2342 configured to rotate around the rocker shaft. The second arm 23 can comprise a stamped sheet forming a hollow body 231, the pivot portion (pivot mounts 2341, 2342), and a connecting body 238. The connecting body 238 can span a section of the main body 11 between a rocker shaft bore 101 and the cam end 103. The spring frame (spring platform 2231) can comprise a first prong formed by the platform strut 2233 for abutting the transfer portion 2330, a second prong formed by strut 2234 for abutting transfer portion 2230, and a spring seat formed by plate portion 2237 spanning between the first prong and the second prong. The spring frame (spring platform 2231) can cup the transfer portion 2230 from a first side, and the second body 23 can comprise a hollow frame 231 that cups the transfer portion 2230 from the first side.

Main body 10 can be used with second body 24. The pivot portion 140 can be near the rocker shaft bore 101 but does not overlap the rocker shaft bore 101. Material use efficiency can result in the second body 24 coming away from under the rocker shaft bore 101 at an angle. Then, the spring plate 31 could be set at an angle, or skewed, so that it positions the lost motion spring 40 to bias the latch bore 2132 to align the latches 51, 52 with the piston bores 135, 136. A lid 320, like lid 310, can form a spring guide 33. To match the angle of the spring plate 32, the hollow body 241 of second body 24 can comprise an angled spring platform 2431. The struts 224, 225 can also be angled. The transfer portion 2430 can comprise a hollow body 241 configured to frame the bearing axle 2131. The transfer portion 2430 can be configured to seat the lost motion spring 40. The second body 24 can be configured to anchor to the pivot portion 2440. The pivot portion 2440 can comprise a pair of main pivot mounts 141 connected to a pair of second pivot mounts2441 via a pivot axle 143. The second arm 24 can comprise a stamped sheet forming a hollow body 241, the pivot portion (second pivot mounts 2441).

While stamped sheet forming is used for the hollow bodies or hollow frames 211, 221, 231, 241, it is possible to use machining, cold-forming, casting, among other techniques to form the components. When cast, inserts and attachments can be used as bushing, bearings, or retainers.

Other implementations will be apparent to those skilled in the art from consideration of the specification and practice of the examples disclosed herein.

What is claimed is:

1. A switchable rocker arm, comprising:

a main body configured to rotate around a rocker shaft, the main body comprising:

a valve end; and a cam end forked to form a first arm border and a second arm border, wherein the first arm border comprises a first piston bore and a first end wall, and wherein the second arm border comprises a second piston bore and a second end wall;

a second body, comprising:

a pivot portion;

a cam-receiving transfer portion; and a latch bore through the cam-receiving transfer portion;

a latch assembly mounted in the latch bore; and a piston assembly mounted in one or more of the first piston bore or the second piston bore.

2. The switchable rocker arm of claim 1, wherein the piston assembly comprises a first piston seated in the first piston bore and a second piston seated in the second piston bore.

3. The switchable rocker arm of claim 2, wherein the main body comprises a hydraulic feed configured to supply hydraulic fluid to the first piston bore and to the second piston bore.

4. The switchable rocker arm of claim 1, comprising a lost motion spring mounted over the cam-receiving transfer portion.

5. The switchable rocker arm of claim 1, comprising a lost motion spring having a center of inertia that is balanced over the cam-receiving transfer portion.

6. The switchable rocker arm of claim 1, comprising a spring plate secured to the cam end and seating a lost motion spring.

7. The switchable rocker arm of claim 1, wherein the cam-receiving transfer portion comprises a bearing axle and a roller bearing mounted to rotate on the bearing axle.

8. The switchable rocker arm of claim 7, wherein the bearing axle comprises the latch bore, and wherein the latch assembly comprises a first latch and a second latch biased out of the latch bore.

9. The switchable rocker arm of claim 7, wherein the cam-receiving transfer portion comprises a hollow body configured to frame the bearing axle.

10. The switchable rocker arm of claim 9, wherein the cam-receiving transfer portion is further configured to seat a lost motion spring.

11. The switchable rocker arm of claim 9, wherein the second body is configured to anchor to the pivot portion.

12. The switchable rocker arm of claim 9, wherein the pivot portion comprises a pair of rocker shaft bearings configured to rotate around the rocker shaft.

13. The switchable rocker arm of claim 1, wherein the second body comprises a stamped sheet forming a hollow body, the pivot portion, and a connecting body.

14. The switchable rocker arm of claim 13, wherein the connecting body spans a section of the main body between a rocker shaft bore and the cam end.

15. The switchable rocker arm of claim 1, further comprising a spring frame comprising:

a first prong for abutting the cam-receiving transfer portion;

a second prong for abutting the cam-receiving transfer portion; and a spring seat spanning between the first prong and the second prong.

16. The switchable rocker arm of claim 15, wherein the spring frame cups the cam-receiving transfer portion from a first side, and wherein the second body comprises a hollow frame that cups the cam-receiving transfer portion from the first side.

17. The switchable rocker arm of claim 15, wherein the spring frame cups the cam-receiving transfer portion from a first side, and wherein the second body comprises a hollow frame that cups the cam-receiving transfer portion from a second side.

* * * * *